US005692477A

United States Patent [19]

Berger et al.

[11] Patent Number: 5,692,477

[45] Date of Patent: Dec. 2, 1997

[54] FUEL SUPPLY ARRANGEMENT FOR AN INTERNAL COMBUSTION ENGINE

[75] Inventors: Frank Berger, Leutenbach; Kurt Moll, Rottenburg, both of Germany

[73] Assignee: Mercedes - Benz AG, Stuttgart, Germany

[21] Appl. No.: 778,780

[22] Filed: Jan. 6, 1997

[30] Foreign Application Priority Data

Jan. 9, 1996 [DE] Germany ..... 19600565.5

[51] Int. Cl.[6] ..... F02M 55/02

[52] U.S. Cl. ..... 123/468; 123/509; 123/470; 123/193.2

[58] Field of Search ..... 123/509, 456, 123/468, 469, 470, 193.1, 193.2, 193.3

[56] References Cited

U.S. PATENT DOCUMENTS

| | | | |
|---|---|---|---|
| 4,350,127 | 9/1982 | King | 123/364 |
| 5,007,401 | 4/1991 | Grohn et al. | 123/509 |
| 5,398,658 | 3/1995 | Mesimaki | 123/509 |
| 5,411,001 | 5/1995 | Werner et al. | 123/468 |
| 5,419,298 | 5/1995 | Nolte et al. | 123/509 |
| 5,479,903 | 1/1996 | Werner et al. | 123/509 |
| 5,564,395 | 10/1996 | Moser et al. | 123/509 |

FOREIGN PATENT DOCUMENTS

| | | |
|---|---|---|
| 0 543 301 | 5/1993 | European Pat. Off. . |
| 43 26 162 | 7/1994 | Germany . |
| 351 799 | 3/1961 | Switzerland . |

*Primary Examiner*—Thomas N. Moulis
*Attorney, Agent, or Firm*—Klaus J. Bach

[57] ABSTRACT

In a fuel supply arrangement for plug-in fuel pumps disposed in reception cavities in the cylinder housing of in-line cylinders of an internal combustion engine, a main fuel supply passage extends through the cylinder housing adjacent the reception cavities for the plug-in pumps and branch-off passages extend from the main fuel passage in alignment with respective fuel passages in the plug-in pump, and sleeves are disposed in the fuel passages of the plug-in pumps and received in the branch passages formed in the cylinder housing for engaging and properly positioning the plug-in pumps with respect to the cylinder housing.

5 Claims, 3 Drawing Sheets

FUEL SUPPLY ARRANGEMENT FOR AN INTERNAL COMBUSTION ENGINE

BACKGROUND OF THE INVENTION

The invention relates to a fuel supply arrangement for supplying fuel to plug-in injection pumps mounted in pump receiving engine block cavities via fuel supply passages extending through the cylinder housing of the engine.

DE 43 26 162 C1 discloses such a fuel supply arrangement with fuel supply passages arranged in the engine housing of a multi-cylinder internal combustion engine which includes a longitudinal main fuel passage and branch passages branching off the main passage. Each branch passage leads to a reception cavity in which a plug-in pump associated with a particular cylinder is disposed. At the level where the branch passage joins the reception cavity, the plug-in pump includes an annular groove through which the pump is in communication with the branch passage to receive fuel therefrom.

It is the object of the present invention to provide a simple fuel supply arrangement by which fuel can be supplied to the plug-in pumps and whereby the plug-in pumps can be fixed in position in the pump receiving bores in a simple and inexpensive manner. The fuel supply arrangement should be particularly suitable for plug-in pumps with electro-magnetic control valves.

SUMMARY OF THE INVENTION

In a fuel supply arrangement for plug-in fuel pumps disposed in reception cavities in the cylinder housing of in-line cylinders of an internal combustion engine, a main fuel supply passage extends through the cylinder housing adjacent the reception cavities for the plug-in pumps. Branchoff passages extend from the main fuel passage and are in alignment with respective fuel passages in the plug-in pump, and sleeves disposed in the fuel passages of the plug-in pumps and received in the branch passages formed in the cylinder housing engage and properly position the plug-in pumps with respect to the cylinder housing.

By the special arrangement of the fuel supply passages in the interface area between the cylinder housing and the top housing part of the plug-in pump, the plug-in pump is fixed in position in the reception bore and the fuel passage connection is safely sealed.

At the same time, as the position of the plug-in pump in the reception bore is fixed, a fuel supply passage connection is made by which fuel can be supplied to the plug-in pump.

In addition, by the particular position of sleeve, which is disposed with one end in the cylinder housing and with the other in the exposed pump housing part, the seal ring surrounding the sleeve is protected from the extremely high fuel pressures generated in the pump.

An embodiment of the invention will be described below on the basis of the accompanying drawings.

DESCRIPTION OF A PREFERRED EMBODIMENT

Figure 1:
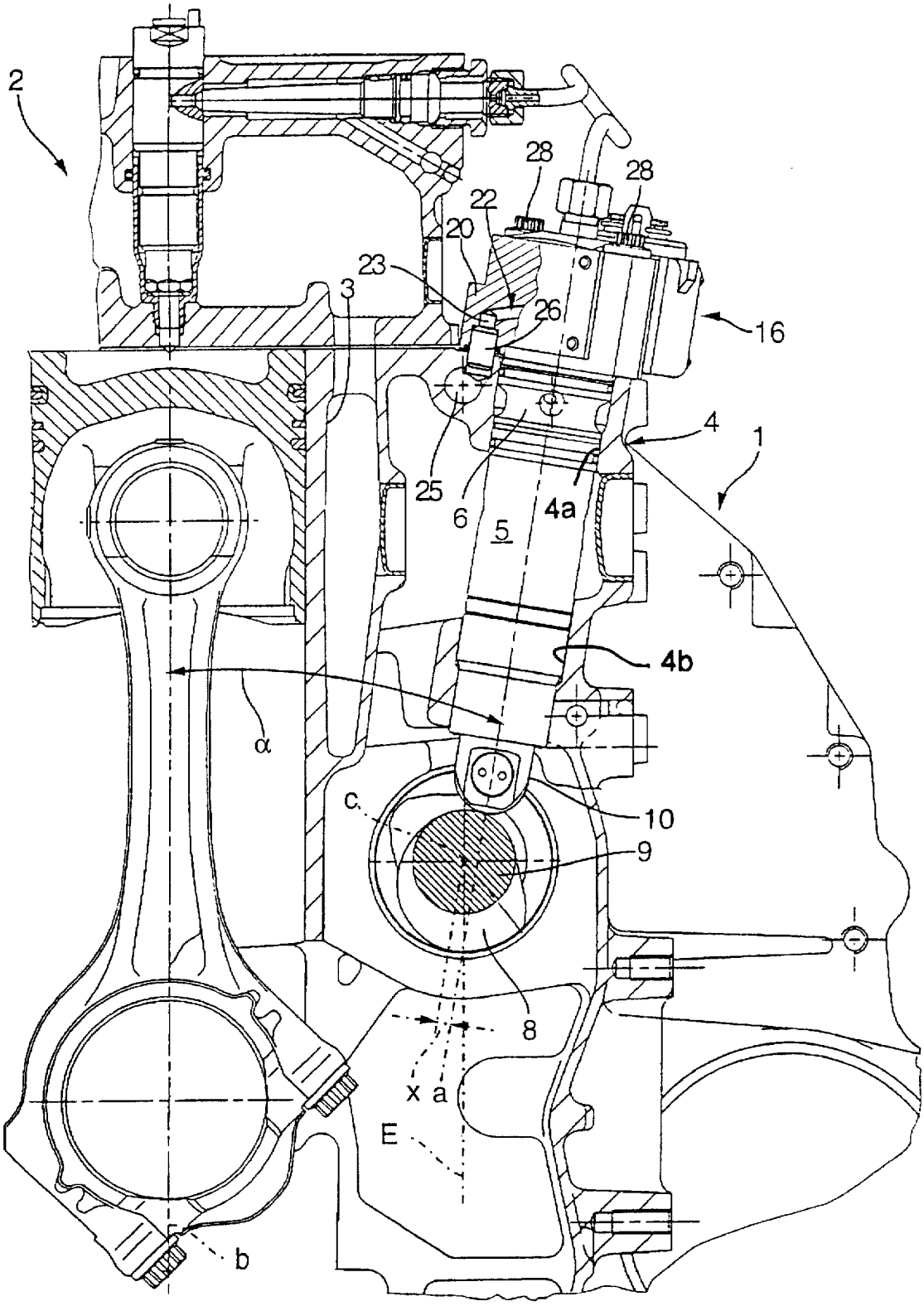
FIG. 1 is a cross-sectional view of a cylinder housing of a multi-cylinder engine with a plug-in pump.
Figure 2:
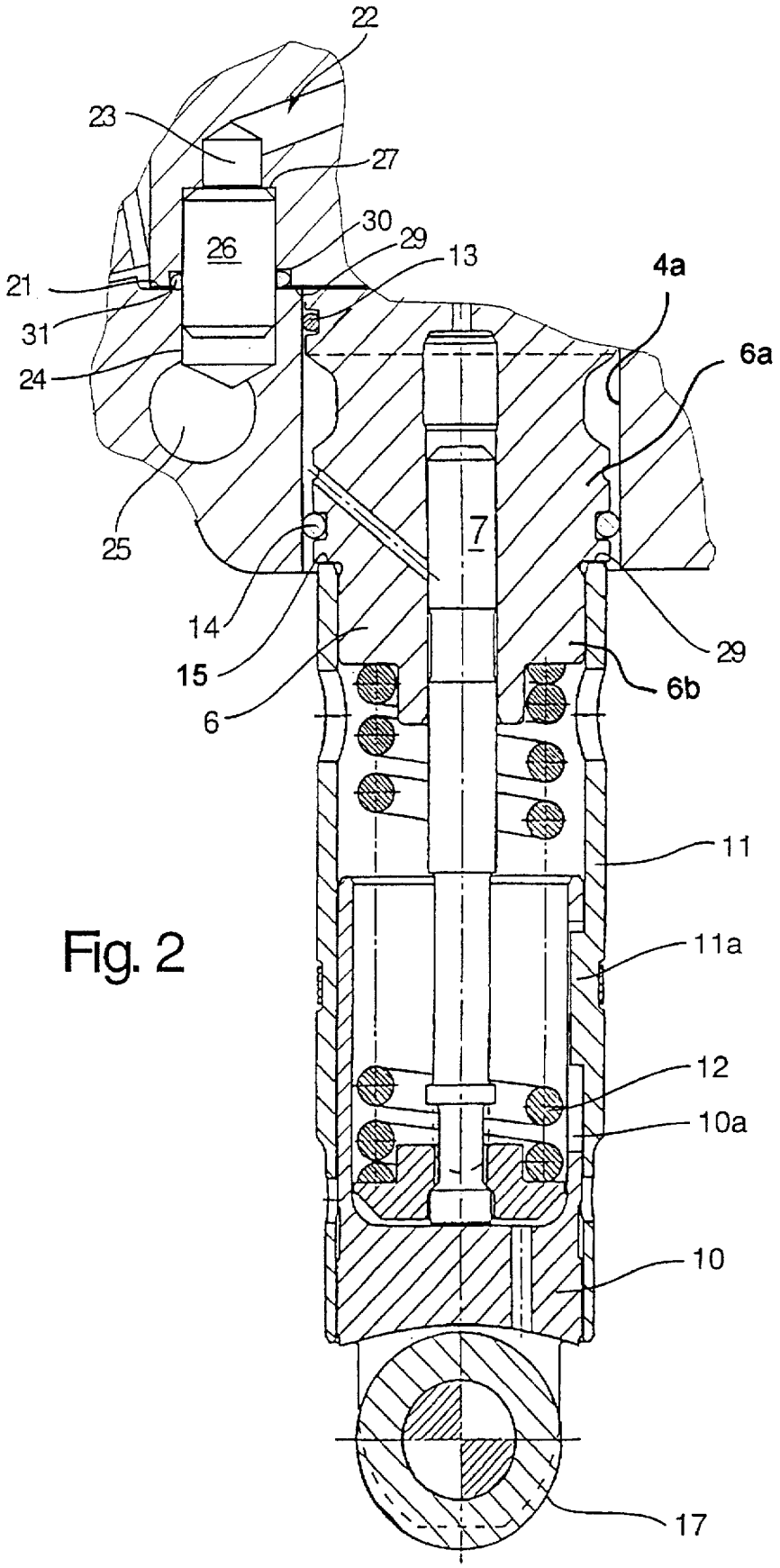
FIG. 2 is an enlarged view showing the plug-in pump.
Figure 3:
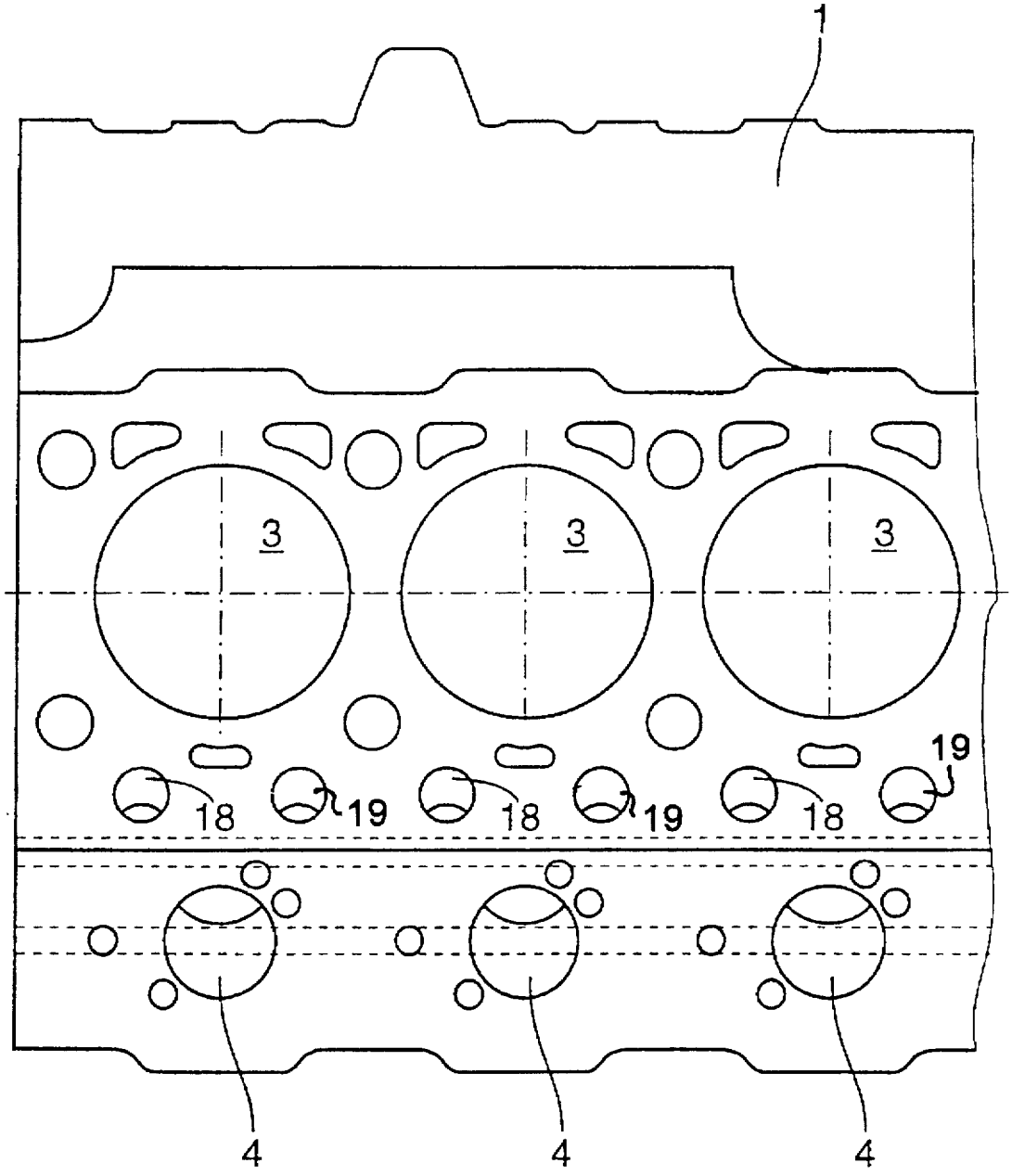
FIG. 3 is a partial view of the cylinder housing of the internal combustion engine.

FIGS. 1 and 3 show a cylinder housing 1 of a multi-cylinder internal combustion engine 2 with cylinders 3 which are arranged in line and with reception cavities 4 in the cylinder housing 1 for the reception of electro-magnetic valve controlled plug-in pumps 5. Each plug-in pump 5, associated with a cylinder 3, comprises a pumping part with pump housing 6 including a pump plunger 7 and an operating part with a spring loaded roller tappet 10 which is operated by a cam 8 of a camshaft 9 and which cooperates with the pump plunger 7. The pumping part and the operating part are combined into a unit by an elongated sleeve 11 (FIG. 2) which is received in the reception cavity 4. The reception cavity 4 comprises spaced sections 4*a*, 4*b*. The upper cavity section 4*a* receives the lower area of the pump housing 6 whereas the lower cavity section 4*b* receives the sleeve 11 with the operating part. In the sleeve 11, the roller tappet 10 is disposed so as to be axially movably against the force of a roller tappet spring 12. The sleeve 11 is provided with a key 11*a* which is received in a slot-like guide 10*a* in the tappet 10 whereby the tappet 10 is held in its angular position and is also held within the sleeve so that the roller tappet cannot fall out of the sleeve 11 when the plug-in pump 5 is removed from the reception cavity 4.

The lower part of the pump housing 6 which is disposed in the reception bore 4 is stepped and has a larger diameter portion 6*a* which is disposed in the upper cavity section 4*a* provided with two seal rings 13, 14 extending in spaced relationship around the pump housing portion 6*a*. The smaller diameter portion 6*b* of the pump housing is firmly connected to the upper part of the sleeve 11. A pressure shoulder 15 formed on the pump housing 6 engages the top face 29 of the sleeve 11.

The exposed part of the pump housing 6 projecting from the reception bore 4 includes an electro-magnetic valve 16 for controlling the fuel flow to the fuel lines to an injector.

The plug-in pump is so positioned that its longitudinal axis a and the cylinder axis b define therebetween an angle of about 10°.

The longitudinal axis a extends essentially normal to the axis c of the camshaft 9 but is displaced therefrom by a distance x against the direction of movement of the surface of the cam 8 at the point of contact with the roller tappet 10. The direction of rotation of the camshaft 9 as shown in FIG. 1 is counter-clockwise such that the roller 17 of the roller tappet acts as a trailing cam follower with an automatically stabilizing orientation.

By the particular positioning and orientation of the plug-in pump 5 with respect to the camshaft 9 the push rod passages 18 and 19 for each cylinder 3 may be arranged more closely adjacent one another so that also the cylinders 3 may be arranged closely adjacent one another (see FIG. 3). This arrangement results in weight savings and also in a reduction of the engine size.

The exposed pump housing part projecting from the reception bore 4 has a sidewardly projecting housing portion 20. This part of the pump housing and the housing projection 20 are disposed on a support surface 21 of the cylinder housing 1 which extends at a right angle with respect to the longitudinal axis a of the plug-in pump 5.

The housing projection 20 includes a fuel passage 22 with a passage section 23 which extends parallel to the longitudinal axis a of the plug-in pump 5 and is arranged in axial alignment with a fuel supply passage 24 (FIG. 2) in the cylinder housing 1. The fuel supply passage 24 branches off a longitudinal main fuel passage 25 which extends through the cylinder housing 1 on the side of the plug-in pumps 5 for supplying fuel to the pumps.

The fuel passage section 23 includes a sleeve 26 which is inserted up to a shoulder 27 and is fixed thereby. The portion of the sleeve 26 projecting from the fuel passage part 23 is received in the fuel supply passage 24 of the cylinder housing 1 to insure proper positioning of the plug-in fuel pump 5 in the reception bore 4. The plug-in pump 5 is mounted to the cylinder housing 1 by mounting screws 28.

The engagement surface 29 of the housing projection 20 opposite the support surface 21 on the cylinder housing 1 is provided with a recess 30 extending around the sleeve 26 in which a seal ring 31 is received which is tightly fitted onto the sleeve 26 so that it remains in position and is not lost when the plug-in pump 5 is removed. The sleeve 26 which provides in this special way safe communication between the fuel supply passages in the cylinder housing and the plug-in fuel pump also protects the seal ring 31 from the high system pressures.

What is claimed is:

1. A fuel supply arrangement in a cylinder housing of an internal combustion engine having cylinders arranged in-line in the cylinder housing, said cylinder housing having for each cylinder a reception cavity for supporting a plug-in pump, a main fuel supply passage formed in said cylinder housing so as to extend longitudinally through said cylinder housing adjacent said reception cavities and branch off passages extending from said main fuel supply passage for supplying fuel to said plug in pumps received in said reception cavities, said plug-in pumps having exposed housing portions projecting from said reception cavities and each including a fuel passage disposed in axial alignment with a respective branch off passage, and a sleeve disposed in each of said branch-off passages and the fuel passage in the respective plug-in pump housing portion for properly positioning said plug-in pump in said reception cavity.

2. A fuel supply arrangement according to claim 1, wherein said sleeve is firmly received in a sideward projection of said exposed pump housing portion which is seated on the cylinder housing.

3. A fuel supply arrangement according to claim 1, wherein said fuel passage includes a passage section which extends parallel to the axis of said plug-in fuel pump and which has a shoulder and includes said sleeve disposed in engagement with said shoulder, said sleeve projecting from said passage section into the respective branch-off passage of said main fuel supply passage.

4. A fuel supply arrangement according to claim 2, wherein said sideward projection of said exposed pump housing portion has a recess formed around said sleeve in its surface opposite the respective support surface of said cylinder housing for receiving a seal ring which tightly surrounds said sleeve.

5. A fuel supply arrangement according to claim 4, wherein the longitudinal axis of each of said plug-in pumps defines with the axis of the associated engine cylinder an angle of about 10°.

* * * * *